United States Patent [19]

Derks et al.

[11] Patent Number: 5,075,589

[45] Date of Patent: Dec. 24, 1991

[54] OXIDE CATHODE

[75] Inventors: Petrus J. A. M. Derks; Carolus A. Smets, both of Eindhoven, Netherlands

[73] Assignee: U.S. Philips Corporation, New York, N.Y.

[21] Appl. No.: 503,402

[22] Filed: Mar. 30, 1990

[30] Foreign Application Priority Data

Apr. 28, 1989 [NL] Netherlands ..... 8901076

[51] Int. Cl.[5] ..... H01J 19/06

[52] U.S. Cl. ..... 313/346 DC; 313/346 R

[58] Field of Search ..... 313/311, 346 R, 346 DC, 313/355

[56] References Cited

U.S. PATENT DOCUMENTS

| | | | |
|---|---|---|---|
| 4,675,091 | 5/1987 | Thomas et al. | 313/346 R |
| 4,797,593 | 1/1989 | Saito et al. | 313/346 R |
| 4,864,187 | 9/1989 | Sano et al. | 313/346 R |

*Primary Examiner*—Donald J. Yusko
*Assistant Examiner*—Diab A. Hamadi
*Attorney, Agent, or Firm*—Norman N. Spain

[57] ABSTRACT

The emission properties of oxide cathodes, in which yttrium oxide, scandium oxide or a rare earth oxide is added to the electron-emissive material, are improved by using fine-grained yttrium, scandium or rare earth oxide.

19 Claims, 1 Drawing Sheet

OXIDE CATHODE

BACKGROUND OF THE INVENTION

The invention relates to a cathode having a supporting body substantially comprising nickel and being coated with a layer of electron-emissive material comprising alkaline earth metal oxides and comprising at least barium and at most 5% by weight of yttrium oxide, scandium oxide, or an oxide of a rare earth metal.

Such cathodes are described, for example, in EP-A-0,210,805. The emission of such cathodes is based on the release of barium from barium oxide. In addition to the barium oxide the electron-emissive material usually comprises strontium oxide and sometimes calcium oxide. Improved electron emission properties are obtained by the addition of yttrium oxide or scandium oxide.

The actual emission is mainly ensured by small areas (so-called "sites") having the lowest effective electron work function, which sites are spread over the electron-emissive material. In practice sites having a slightly higher work function will hardly contribute to the electron current generated by the cathode.

For a high effective electron emission it is therefore favourable to choose the number of sites having a minimum possible work function as optimally as possible in the total distribution of sites.

SUMMARY OF THE INVENTION

A cathode according to the invention is therefore characterized in that the yttrium oxide or scandium oxide or oxide of the rare earth metal is present in the electron-emissive material as particles the majority of which have a diameter of at most 5 μm and preferably at most 1 μm.

The emissive material preferably comprises up to about 1% by weight of yttrium oxide, scandium oxide or oxide of a rare earth metal.

In a preferred embodiment the electron-emissive material comprises about 0.1–1% by weight of yttrium oxide or scandium oxide.

In another preferred embodiment the electron-emissive material comprises about 0.02–0.5% by weight of europium oxide.

The invention is based on the recognition that the size of the grains influences the number of sites formed. It is found that for a smaller grain size it is sufficient to have smaller quantities of yttrium oxide, scandium oxide or the rare earth oxide in the emissive layer.

BRIEF DESCRIPTION OF THE DRAWING

The invention will now be described in greater detail with reference to an embodiment and the drawing in which FIG. 1 is a diagrammatic cross-sectional view of a cathode according to the invention, while

DESCRIPTION OF THE PREFERRED EMBODIMENTS

Figure 1:
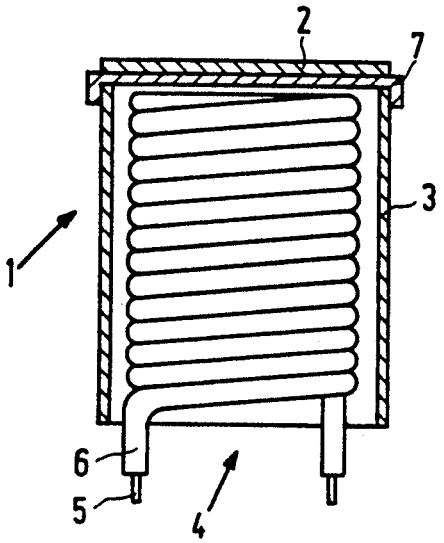

The cathode 1 in the embodiment of FIG. 1 has a cylindrical nichrome cathode shaft 3 provided with a cap 7. The cap 7 substantially comprises nickel and may comprise reducing means such as, for example, silicon, magnesium, manganese, aluminium and tungsten. The cathode shaft 3 accommodates a helical filament 4 which comprises a metal helically wound core 5 and an electrically insulating aluminium oxide layer 6.

An approximately 70 μm thick layer of emissive material 2 is present on the cap 7, which layer is provided, for example by means of spraying. The layer 2 comprises, for example a mixture of barium oxide, and strontium oxide obtained by providing and subsequently decomposing barium strontium carbonate, or a mixture of barium oxide, strontium oxide and calcium oxide.

Moreover, a given quantity of yttrium oxide or scandium oxide has been added to the mixture.

Cathodes having an emissive layer comprising a mixture of barium oxide and strontium oxide to which 0.6% by weight, 1.3% by weight, 2.5% by weight, 5% by weight and 10% by weight, respectively, of yttrium oxide was added, were mounted in a cathode ray tube. The yttrium oxide which was added to the mixture comprised grains half of which had a diameter of 4.5 μm or less ($d_{50}=4.5$ μm).

After standard mounting and activation of the cathodes in the tubes, the cathode ray tubes were operated for 2000 hours at a filament voltage of 7 V, which is comparable to approximately 10,000 real operating hours. Before and after this life test, emission measurements were performed at a filament voltage of 7 V after 30 seconds of conveying current at a cathode load of $2.2A/cm^2$ (so-called $\Delta i_{k,30}$ measurement).

Figure 2:
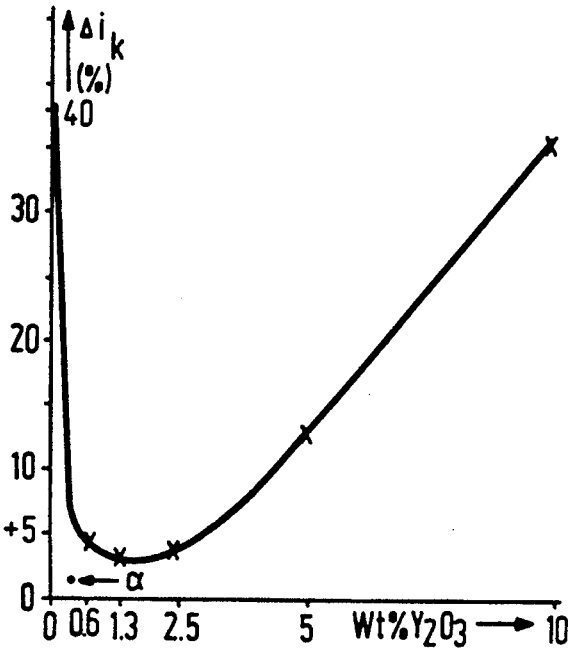
FIG. 2 is a graphic depiction of the results of life tests on cathode ray tubes comprising cathodes having different percentages of yttrium oxide in the layer of electron-emissive material for a first value of the grain diameter of the yttrium oxide powder and FIG. 3 is similar to FIG. 2, except that it depicts results under different test conditions for another value of the grain diameter of the yttrium oxide powder.

The decrease in emission current was 5.1%, 3.5%, 3.9%, 12.8% and 35.7%, respectively, while it was 38% in the case without any additions. The curve of FIG. 2 was drawn through the points thus found, and gives a rough indication of the relationship between the quantity of yttrium oxide (with grain size $d_{50}=4.5$ μm) and the emission process. FIG. 2 also shows the point α indicating the variation of the emission (a decrease of 0.7%) under indentical conditions for an addition of 0.3% by weight of yttrium oxide having a smaller grain size ($d_{50}=0.9$ μm).

Figure 3:
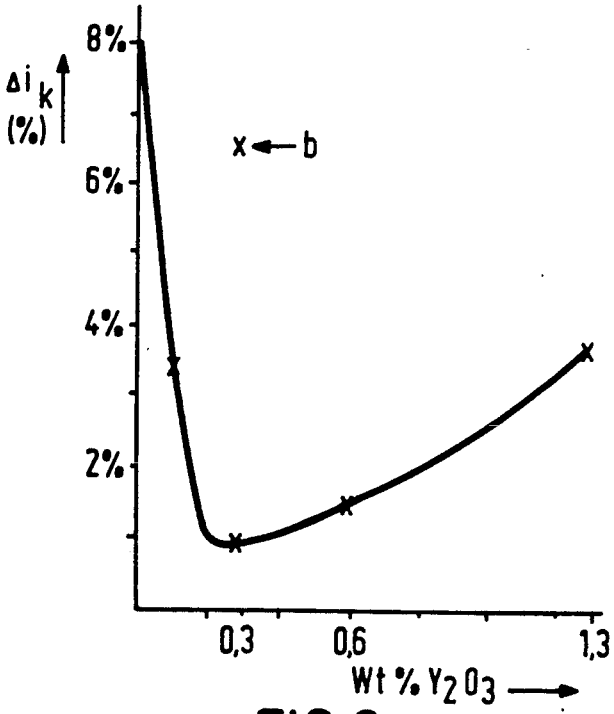

FIG. 3 shows a similar dependence of the emission process on the added quantity of yttrium oxide, which consisted of grains half of which had a diameter of 0.9 μm or less ($d_{50}=0.9$ μm). Cathodes with emissive layers comprising a mixture of barium oxide and strontium oxide with additions of 0.1% by weight, 0.3% by weight, 0.6% by weight and 1.3% by weight $Y_2O_3$, respectively, were mounted in cathode ray tubes, activated in the conventional manner, and then subjected to an accelerated and heavier life test. The load of the cathode was $4A/cm^2$, which load was also maintained during the emission measurement. The decrease in emission was 3.24%, 0.82%, 1.42% and 3.56%, respectively, after 100 hours, while it was 8.09% in the case without any additions. For a tube with a cathode to which 0.3% by weight of the coarser yttrium powder ($d_{50}=4.5$ μm) had been added, the decrease of the emission was 6.49% under the same test conditions (point b in FIG. 3).

It is clearly apparent from FIGS. 2 and 3 that the same or better results can be obtained when using smaller quantities with a smaller grain size of added yttrium oxide.

Also other properties which are characteristic of cathode ray tubes, such as the roll-off point (the point at which the emission current in the cathode ray tube has decreased by 10%, when the filament voltage across the filament is decreased, as compared with the emission current at a filament voltage of 8.5 V) had optimum values at those quantities of yttrium oxide where the curves of FIGS. 2 and 3 exhibited a minimum decrease of the emission.

The decrease of the quantity of yttrium oxide to be added is approximately proportional to the decrease of the average diameter of the yttrium oxide grains.

A similar relationship was found in tests in which europium oxide ($Eu_2O_3$) was added to the emissive layer at diameters ($d_{50}$) of 2.5 μm and 0.5 μm, respectively. Tests similar to those described with reference to FIG. 2 proved that addition of 0.3% by weight of coarse-grained europium oxide ($d_{50}$=2.5 μm) resulted in an emission decrease of about 8.5% after 100 hours, while addition of about 0.05% by weight of the fine-grained europium oxide ($d_{50}$=0.5 μm) resulted in a decrease of only 4.3%.

Moreover, since approximately 25 times as many particles of the fine-grained material are used at this lower weight percentage, as compared with the weight percentage required to achieve an optimum result for coarse-grained material, the fine-grained particles are distributed more homogeneously, which leads to a more uniform emission behaviour.

The invention is of course not limited to the embodiments shown, but several variations are possible. For example, when using scandium oxide instead of yttrium oxide, an improved emission at low percentages by weight and smaller grain sizes can be found in a similar manner. Similarly as for europiium oxide, an optimum percentage can be found for oxides of other rare earth metals at smaller grain sizes. The cathode may also be designed in various ways (cylindrical, concave, convex, etc.) and there are various methods of providing the electron-emissive layer.

We claim:

1. A cathode comprising a supporting body substantially comprising nickel and a layer of electron-emissive material comprising alkaline earth metal oxides, barium and at most 5% by weight of yttrium oxide, scandium oxide or an oxide of a rare earth metal, characterized in that the yttrium oxide, scandium oxide or oxide of the rare earth metal is present in the electron-emissive material as particles the majority of which have a diameter of at most 5 μm.

2. A cathode as claimed in claim 1, characterized in that the majority of the particles have a diameter of at most 1 μm.

3. A cathode as claimed in claim 1 characterized in that the electron-emissive material comprises 0.02–1% by weight of yttrium oxide, scandium oxide or oxide of a rare earth metal.

4. A cathode as claimed in claim 3, characterized in that the electron-emissive material comprises 0.1–1% by weight of yttrium oxide or scandium oxide.

5. A cathode as claimed in claim 1, characterized in that the electron-emissive material comprises 0.02–0.5% by weight of europium oxide.

6. A cathode as claimed in claim 1, characterized in that the alkaline earth oxides mainly comprises barium oxide and strontium oxide.

7. A cathode as claimed in claim 1 characterized in that the supporting body includes reducing means.

8. A cathode as claimed in claim 2, characterized in that the electron-emissive material comprises 0.02–1% by weight of yttrium oxide, scandium oxide or oxide of a rare earth metal.

9. A cathode as claimed in claim 2, characterized in that the electron-emissive material comprises 0.02–0.5% by weight of europium oxide.

10. A cathode as claimed in claim 3, characterized in that the electron-emissive material comprises 0.02–0.5% by weight of europium oxide.

11. A cathode as claimed in claim 2, characterized in that the alkaline earth oxides mainly comprise barium oxide and strontium oxide.

12. A cathode as claimed in claim 3, characterized in that the alkaline earth oxides mainly comprise barium oxide and strontium oxide.

13. A cathode as claimed in claim 4, characterized in that the alkaline earth oxides mainly comprise barium oxide and strontium oxide.

14. A cathode as claimed in claim 5, characterized in that the alkaline earth oxides mainly comprise barium oxide and strontium oxide.

15. A cathode as claimed in claim 2, characterized in that the supporting body includes reducing means.

16. A cathode as claimed in claim 3, characterized in that the supporting body includes reducing means.

17. A cathode as claimed in claim 4, characterized in that the supporting body includes reducing means.

18. A cathode as claimed in claim 5, characterized in that the supporting body includes reducing means.

19. A cathode as claimed in claim 6, characterized in that the supporting body includes reducing means.

* * * * *